US008058612B2

(12) United States Patent
Janata et al.

(10) Patent No.: US 8,058,612 B2
(45) Date of Patent: Nov. 15, 2011

(54) MICROIRRADIATORS AND METHODS OF MAKING AND USING SAME

(75) Inventors: Jiri Janata, Atlanta, GA (US); Miroslava Josowicz, Atlanta, GA (US); Jennifer Steeb, Jensen Beach, FL (US); William S. Dynan, Martinez, GA (US); Wendy Kuhne, Evans, GA (US)

(73) Assignee: Georgia Tech Research Corporation, Atlanta, GA (US)

( * ) Notice: Subject to any disclaimer, the term of this patent is extended or adjusted under 35 U.S.C. 154(b) by 166 days.

(21) Appl. No.: 12/698,065

(22) Filed: Feb. 1, 2010

(65) Prior Publication Data

US 2010/0200771 A1 Aug. 12, 2010

Related U.S. Application Data

(60) Provisional application No. 61/148,668, filed on Jan. 30, 2009.

(51) Int. Cl.

| | |
|---|---|
| ***G21G 4/06*** | (2006.01) |
| ***C25D 5/02*** | (2006.01) |
| ***G21K 5/08*** | (2006.01) |

(52) U.S. Cl. ..... 250/308; 250/310; 250/440.11; 250/493.1; 378/64; 204/478

(58) Field of Classification Search ..... 250/308, 250/310, 440.11, 493.1; 378/64; 204/478
See application file for complete search history.

(56) References Cited

U.S. PATENT DOCUMENTS

| | | | | |
|---|---|---|---|---|
| RE34,421 | E | 10/1993 | Parker et al. | |
| 5,339,347 | A | 8/1994 | Slatkin et al. | |
| 6,580,940 | B2 | 6/2003 | Gutman | |
| 7,194,063 | B2 | 3/2007 | Dilmanian et al. | |
| 7,200,203 | B2 | 4/2007 | Cocks et al. | |
| 7,283,610 | B2 * | 10/2007 | Low et al. | 378/65 |
| 2005/0008121 | A1 | 1/2005 | Low et al. | |
| 2006/0133575 | A1 | 6/2006 | Gutman et al. | |
| 2008/0192892 | A1 | 8/2008 | Dilmanian et al. | |
| 2008/0247510 | A1 | 10/2008 | Gertner et al. | |
| 2010/0101955 | A1 * | 4/2010 | Nocera et al. | 204/547 |
| 2010/0197524 | A1 * | 8/2010 | Janata et al. | 506/30 |

FOREIGN PATENT DOCUMENTS

| | | | |
|---|---|---|---|
| WO | 0114617 | A1 | 3/2001 |
| WO | 2004103457 | A2 | 12/2004 |

OTHER PUBLICATIONS

Becerril-Vilchis, A. et al., "A Method for the Preparation of Very Thin and Uniform α-Radioactive Sources", Nuclear Instruments and Methods in Physics Research Section A, vol. 369, pp. 613-616, 1996.
Robinson, P.S., "The Production of Radioactive Sources by the Electrospraying Method", Nuclear Instruments and Methods, vol. 40, pp. 136-140, 1966.

(Continued)

*Primary Examiner* — Nikita Wells
(74) *Attorney, Agent, or Firm* — Ryan A. Schneider, Esq.; Troutman Sanders LLP

(57) ABSTRACT

Improved radiation devices and their associated fabrication and applications are described herein. The microirradiators generally include a non-radioactive conducting electrode, an insulating sheath, a radioactive source, and, optionally, a contact electrode. The microirradiators generally produce low absolute radiation levels with high radiation flux densities.

20 Claims, 8 Drawing Sheets

OTHER PUBLICATIONS

Rodriguez, Manuel et al., "Design of a Radiation Facility for Very Small Specimens Used in Radiobiology Studies", Physics in Medicine and Biology, vol. 53, pp. 2953-2970, May 12, 2008.

Steeb, Jennifer et al., "Nickel-63 Microirradiators", Analytical Chemistry, vol. 81, No. 5, pp. 1976-1981, Mar. 1, 2009.

Summerour, Jamie et al., "A Beta Microirradiator", Radiation Physics and Chemistry, vol. 75, pp. 369-374, 2006.

* cited by examiner

MICROIRRADIATORS AND METHODS OF MAKING AND USING SAME

CROSS-REFERENCE TO RELATED APPLICATION

The present application claims the benefit of U.S. Provisional Patent Application Ser. No. 61/148,668, filed 30 Jan. 2009, and entitled "Microirradiator," which is hereby incorporated by reference in its entirety as if fully set forth below.

TECHNICAL FIELD

The various embodiments of the present invention generally relate to small-scale radiation devices that produce low-dose radiation with high flux densities, and to the methods of making and using such devices.

BACKGROUND

In order to study the effects of radiation on a sample, a controlled dose of radiation must be introduced into the sample, or a localized area thereof. When the sample is relatively small (e.g., biological cells, integrated circuit device components, and the like), the radiation device should be capable of delivering a radiation beam that is on the same, or similar, scale. For example, in radiobiological experiments where single cells are to be dosed, the ideal irradiator should have a compact radiation beam with a cross-sectional dimension on the order of about 1 to about 30 micrometers. Existing radiation devices that can be used for such purposes, however, have several deficiencies. Specifically, these radiation devices can be very costly and involve high absolute levels of radioactivity that require sophisticated shielding to form the desired radiation beam. Another problem is that the beam from the radioactive source is typically large in relation to the area of the target, and must be shielded and/or collimated (e.g., with optical and/or magnetic lenses) to form the desired radiation beam. Yet another problem is that some of these radiation devices cannot function properly under all conditions and, thus, place constraints on certain targets that are not practicable, such as requiring a vacuum to irradiate a wet biological sample.

There accordingly remains a need in the art for improved radiation devices that can be used to irradiate relatively small areas. It is to the provision of such "microirradiators," as well as their associated fabrication techniques and applications, that the various embodiments of the present invention are directed.

BRIEF SUMMARY

Briefly described, the various embodiments of the present invention provide improved radiation devices, methods for making such devices, and methods for using such devices. For example, various embodiments of the present invention are directed to microirradiators. The microirradiators generally include a non-radioactive conducting electrode, an insulating sheath, a radioactive source, and, optionally, a contact electrode.

According to some embodiments, a microirradiator includes a non-radioactive conducting electrode, an insulating sheath that is disposed about at least a portion of the non-radioactive conducting electrode along a longitudinal axis of the non-radioactive conducting electrode, and a radioactive source in electrical communication with the non-radioactive conducting electrode. The radioactive source can be positioned at a terminus of a first longitudinal end of the non-radioactive conducting electrode via electroplating. In addition, the insulating sheath can be disposed about at least a portion of the radioactive source along a longitudinal axis of the radioactive source.

In some cases, a terminus of the insulating sheath can be level with a terminus of the radioactive source. In other cases, the terminus of the insulating sheath can extend beyond the terminus of the radioactive source to define a recess or channel within the insulating sheath.

It is possible for the microirradiator to also include a contact electrode in electrical communication with the non-radioactive conducting electrode. This contact electrode can be electrically coupled to the non-radioactive conducting electrode within the insulating sheath.

In some situations, the average thickness of the electroplated radioactive source along the longitudinal axis is less than or equal to about 50 micrometers. The microirradiator, in some cases, can produce an absolute radiation of less than or equal to about 1000 Becquerels and a radiation flux density of greater than or equal to about $10^4$ Becquerels per square centimeter. The target of the radiation can have an average longest cross-sectional dimension of less than or equal to about 30 micrometers.

In some implementations the non-radioactive conducting electrode can be an inert metal, the insulating sheath can be a glass capillary tube, and the radioactive source can be an elemental radioisotope.

According to other embodiments of the present invention, a microirradiator can include a non-radioactive conducting electrode, an insulating sheath disposed about at least a portion of the non-radioactive conducting electrode along a longitudinal axis of the non-radioactive conducting electrode such that a terminus of a first longitudinal end of the non-radioactive conducting electrode extends beyond the insulating sheath to define a probe. The microirradiator can also include a radioactive source that is in electrical communication with the non-radioactive conducting electrode, wherein the radioactive source is electroplated on the probe.

In some situations, the microirradiator can also include a contact electrode that is in electrical communication with the non-radioactive conducting electrode. This contact electrode can be electrically coupled to the non-radioactive conducting electrode within the insulating sheath.

In some situations, the average thickness of the electroplated radioactive source along the longitudinal axis is less than or equal to about 50 micrometers. The microirradiator, in some cases, can produce an absolute radiation of less than or equal to about 1000 Becquerels and a radiation flux density of greater than or equal to about $10^4$ Becquerels per square centimeter.

This microirradiator can be configured to be inserted into a target of radiation. The target of the radiation can have an average longest cross-sectional dimension of less than or equal to about 30 micrometers.

In some implementations the non-radioactive conducting electrode can be an inert metal, the insulating sheath can be a glass capillary tube, and the radioactive source can be an elemental radioisotope.

Other embodiments are directed to methods of making a microirradiator. According to some embodiments, such a method includes disposing an insulating sheath about at least a portion of a non-radioactive conducting electrode, and electroplating a radioactive source at or about a terminus of a first longitudinal end of the non-radioactive conducting electrode. In some implementations, the disposing step can be accomplished by inserting the non-radioactive conducting electrode into the insulating sheath. The method can also include electrically coupling a contact electrode to the non-radioactive conducting electrode.

Other aspects and features of embodiments of the present invention will become apparent to those of ordinary skill in the art, upon reviewing the following detailed description in conjunction with the accompanying figures.

DETAILED DESCRIPTION

Figure 1:
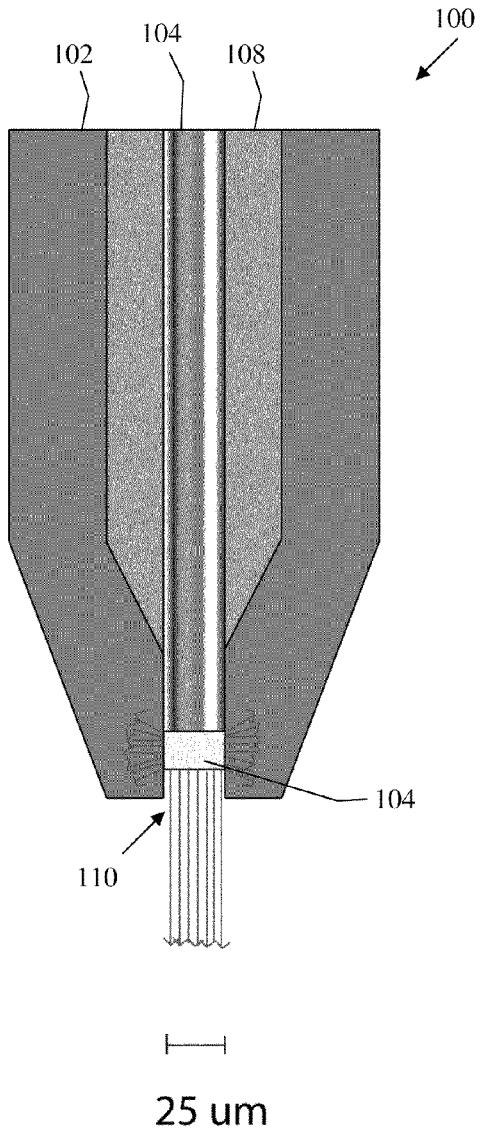
FIG. 1 is a schematic illustration a cross-section of a portion of an exemplary microirradiator in accordance with some embodiments of the present invention.

Referring now to the figures, wherein like reference numerals represent like parts throughout the several views, exemplary embodiments of the present invention will be described in detail. Throughout this description, various components can be identified as having specific values or parameters, however, these items are provided as exemplary embodiments. Indeed, the exemplary embodiments do not limit the various aspects and concepts of the present invention as many comparable parameters, sizes, ranges, and/or values can be implemented. The terms "first," "second," and the like, "primary," "secondary," and the like, do not denote any order, quantity, or importance, but rather are used to distinguish one element from another. Further, the terms "a," "an," and "the" do not denote a limitation of quantity, but rather denote the presence of "at least one" of the referenced item.

The various embodiments of the present invention provide improved radiation devices, along with methods for making and using such devices. In general, the improved radiation devices make use of compact radioactive sources that render the devices capable of delivering localized high density radiation to small targets. Advantageously, because the improved radiation devices use compact radioactive sources, additional external shielding and/or collimating is not necessary in order to produce a beam with a cross-sectional dimension on the micrometer scale. Additionally, in contrast to some existing radiation devices, the radiation devices of the present invention can be used in a variety of applications and conditions, without placing unworkable constraints on the target sample. The radiation devices of the present invention are also beneficial in that they produce low absolute radiation levels that are safe for the user, but that can still irradiate the target sample as desired. Finally, as will be shown below, the radiation devices of the present invention use relatively inexpensive materials and can be fabricated in a manner that is low in cost.

The radiation devices of the present invention, also described herein as "microirradiators," include a non-radioactive conducting electrode, a radioactive source, and an insulating sheath.

The non-radioactive conducting electrode serves as a vehicle for providing a current from an electrical source to the radioactive source in order to effect the emission of radiation from the radioactive source to a specified target. As such, the non-radioactive conducting electrode can be formed from any suitably conducting material, provided that it can withstand the conditions to which the radiation device will be exposed. For example, the non-radioactive conducting electrode should not melt, oxidize, decompose, or degrade at the temperatures of operation of the radiation device. Suitable materials for making the non-radioactive conducting electrode include metals, alloys, conducting ceramic materials, conducting polymers, carbon fibers, carbon nanotubes, and the like.

Structurally, the insulating sheath is disposed about at least a portion of the non-radioactive conducting electrode along the non-radioactive conducting electrode's longitudinal axis. The insulating sheath serves to electrically isolate the non-radioactive conducting electrode (or at least the portion thereof that is encapsulated by the insulating sheath) from any other conducting material to which it would be exposed in the absence of the insulating sheath. Stated another way, the insulating sheath ensures that any current traveling through the non-radioactive conducting electrode flows along the longitudinal axis from the electrical source to the radioactive source. In addition, the insulating sheath helps to minimize or prevent the non-radioactive conducting electrode (or at least the portion thereof that is encapsulated by the insulating sheath) from experiencing any adverse effects as a result of the environmental or atmospheric conditions to which the radiation device is exposed. Further, in some cases, the insulating sheath can serve to provide mechanical stability and/or structure to the radiation device.

The insulating sheath can be formed from any electrically insulating material such that there is no, or substantially no, electrical communication between the insulating sheath and the non-radioactive conducting electrode. Suitable materials for making the insulating sheath include glass, quartz, epoxies, acetates, acrylics, polyimides, polycarbonates, silicon rubbers, polystyrenes, polyurethanes, insulating ceramics, and the like.

The radioactive source serves as the location for emission of the radioactive irradiation from the radiation device. As indicated above, the radioactive source and the non-radioactive conducting electrode are in electrical communication with one another. More specifically, the radioactive source is in electrical communication with a first longitudinal end of the non-radioactive conducting electrode. For example, in some cases, as will be described in more detail below, the radioactive source can be disposed on a surface at the first longitudinal end of the non-radioactive conducting electrode. This surface at the end of the non-radioactive conducting electrode can be at least substantially flush with the surface of the insulating sheath at the same longitudinal end of the insulating sheath. Alternatively, this surface can be beneath the surface of the insulating sheath at same longitudinal end of the insulating sheath so as to create a channel or recess within the insulating sheath.

In other cases, which will also be described in more detail below, the radioactive source can be disposed not only on a surface at the first longitudinal end of the non-radioactive conducting electrode, but also on at least a portion of the side surfaces (along the longitudinal axis) of the non-radioactive conducting electrode on which there is no insulating sheath disposed. These end and side surfaces at the first longitudinal end of the non-radioactive conducting electrode must extend beyond the surface of the insulating sheath at the same longitudinal end of the insulating sheath.

The radioactive source can be formed from any radioactive material, provided that it is not adversely affected by the conditions to which the radiation device is exposed. For example the radioactive source should not chemically react or degrade as a result of being exposed to the target of the radiation device. Suitable radioactive materials include elemental radioisotopes, radioactive polymers, and the like. Such materials are known to those skilled in the art to which this disclosure pertains. As but a few examples, if alpha particles are desired, the radioactive source can be U-238; if beta particles are desired, the radioactive source can be Ni-63 or I-131; and if gamma particles are desired, the radioactive source can be Co-60, U-238, or I-131.

In general, it is desirable for the average thickness of the radioactive source, whether only on the surface at the first longitudinal end of the non-radioactive conducting electrode or on both the surface at the first longitudinal end and the side surfaces (along the longitudinal axis) of the non-radioactive conducting electrode, to be less than or equal to about 50 micrometers. In certain cases, where the use of the radioactive source material is sought to be minimized, the average thickness of the radioactive source is less than or equal to about 10 micrometers.

In some situations, it may be desirable to minimize the amount of the non-radioactive conducting electrode employed in the radiation device. For example, the non-radioactive conducting electrode may be formed from a material that is sensitive to ambient conditions or that is relatively expensive, and there may be a large distance between the electrical source (at one end of the non-radioactive conducting electrode) and the radioactive source (at the other end). To obviate these issues, and others, the radiation device can further include an optional contact electrode, which has a different composition than the non-radioactive conducting electrode and is in electrical communication therewith.

The non-radioactive conducting electrode and the optional contact electrode can be electrically coupled (e.g., via a chemical or mechanical means) so as to still enable provision of a current from the electrical source to the radioactive source in order to effect the emission of radiation from the radioactive source to the specified target. In certain cases, the contact electrode and the non-radioactive conducting electrode can be electrically coupled inside of the insulating sheath, such that only the contact electrode extends beyond one end of the insulating sheath. It should be noted that the contact electrode can have its own insulating sheath disposed about at least a portion of it along the longitudinal axis. Further, the contact electrode can be formed from any of the materials that would be suitable for the non-radioactive conducting electrode described above.

By way of example, if the non-radioactive conducting electrode is formed from an inert metal (e.g. platinum, palladium, gold, silver, and the like) that is expensive, the use of the optional contact electrode, such as a copper wire, could reduce the amount of the expensive inert metal used and/or the overall cost associated with the radiation device. Electrically coupling the contact electrode and the non-radioactive conducting electrode can be achieved using, for example, a conducting epoxy.

In general, the radiation devices of the present invention can be made by disposing the insulating sheath around at least a portion of the non-radioactive conducting electrode, and electroplating the radioactive source on a surface at the first longitudinal end of the non-radioactive conducting electrode. If the radioactive source is to be disposed on at least a portion of the side surfaces, in the direction of the longitudinal axis, of the non-radioactive conducting electrode, then these surfaces can be electroplated with the radioactive source as well. When the optional contact electrode is incorporated into the radiation device, it can be electrically coupled to the non-radioactive conducting electrode at any point in this fabrication process.

Such radiation devices are capable of producing high dose densities with low absolute radiation levels. Because of the size of the devices, the absolute radiation levels are on the order of $10^3$ Becquerels (Bq) or less. In some cases, the absolute radiation levels are on the order of single-digit Bq. Nevertheless, this corresponds to radiation flux densities on the order of $10^4$ Becquerels per square centimeter ($Bq/cm^2$) or more.

By way of illustration, radiations devices that are intended to be encompassed by the various embodiments of the present invention will now be described. Methods of making these illustrative devices will also be provided.

Reference will now be made to FIG. 1, which illustrates a cross-section of a portion of an exemplary microirradiator in accordance with some embodiments of the present invention. The exemplary microirradiator is generically designated by reference numeral 100. This type of microirradiator is suitable for irradiating an external surface of a target sample.

The microirradiator 100 includes an insulating sheath 102, which is formed from a borosilicate glass capillary tube. Disposed within the glass capillary tube sheath 102 is the non-radioactive conducting electrode 104, which is formed from a platinum wire. The radioactive source 106, which is an elemental radioisotope such as Ni-63, is disposed at one longitudinal end of the platinum wire electrode 104. This longitudinal end of the platinum wire electrode 104 is beneath the surface of the insulating sheath 102 at same longitudinal end of the insulating sheath 102 so as to create a channel or recess 110 within the insulating sheath 102. The recess 110 can serve to focus or collimate the radiation beam that is emitted from the radioactive source 106. Further, as shown in FIG. 1, the use of the boron in the borosilicate glass capillary tube sheath 102 can serve to shield the user from any radiation emitted from the sides of the radioactive source 106.

While not shown in FIG. 1, the longitudinal end of the platinum wire electrode 104 on which the radioactive source 106 is disposed can be flush with the surface of the insulating sheath 102 at the same longitudinal end of the insulating sheath 102. This design may be beneficial when a wider radioactive beam is desired, such as when the target of the radiation is larger than the cross-sectional dimension of the radioactive source 106.

The platinum wire electrode 104 in the microirradiator 100 shown in FIG. 1 has a cross-sectional dimension of about 25 micrometers. This specific size is shown only by way of example and is not intended to be limiting. Thus, as would be understood by those skilled in the art to which this disclosure pertains, the platinum wire electrode 104 can have any cross-sectional dimension that would be appropriate for the target of the radiation.

In the radiation device 100 shown in FIG. 1, the cross-sectional dimension of the platinum wire electrode 104 is not as large as the inner cross-sectional dimension of the insulating sheath 102. This void space can be occupied by the optional contact electrode (not shown) or by the chemical or mechanical link between the non-radioactive conducting electrode 104 and the optional contact electrode. In the microirradiator 100 of FIG. 1, the void space is occupied by a conducting epoxy resin 108, which is used to chemically couple the non-radioactive conducting platinum wire electrode 104 and the optional contact electrode.

The insulating sheath 102 can extend to the other longitudinal end of the non-radioactive conducting electrode 104 (i.e., the end opposite to that where the radioactive source 106 is disposed), such that the contact electrode only extends beyond the end of the insulating sheath 102. In this case, the contact electrode can be coupled to the non-radioactive conducting electrode 104 at least partially inside the insulating sheath 102, as shown in FIG. 1; or the contact electrode can be coupled to the non-radioactive conducting electrode 104 only at the longitudinal end of the non-radioactive conducting electrode 104.

Alternatively, the insulating sheath 102 can extend beyond the other longitudinal end of the non-radioactive conducting electrode 104, such that at least a portion of the contact electrode also extends into the insulating sheath 102. In such cases, the contact electrode is coupled to the non-radioactive conducting electrode 104 entirely inside the insulating sheath 102.

Finally, in some cases, the other longitudinal end of the non-radioactive conducting electrode 104 extends beyond the same longitudinal end of the insulating sheath 102. In such cases, the contact electrode can be coupled to the non-radioactive conducting electrode 104 outside of the insulating sheath 102. It should be noted that if a portion of the contact electrode also extends into the insulating sheath 102, then the contact electrode can also be coupled to the non-radioactive conducting electrode 104 at least partially inside of the insulating sheath 102.

The microirradiator 100 of FIG. 1 can be fabricated by first inserting the platinum wire electrode 104 into the opening of the borosilicate glass capillary tube sheath 102. One end of the capillary tube sheath 102 with the platinum wire electrode 104 therethrough can be sealed and/or pulled for stability. This optional sealing and/or pulling step can result in the tapered and tight fit between the platinum wire electrode 104 and the borosilicate glass capillary tube sheath 102 (i.e., the inner cross-sectional dimension of the sheath 102 will be at least substantially similar to the cross-sectional dimension of the electrode 104). This end of the capillary tube sheath 102 with the platinum wire electrode 104 therethrough can be mechanically polished and/or chemically etched to create a flush surface. If a channel or recess is desired, at least a portion of the platinum wire electrode 104 can be chemically etched to produce the recess within the sheath 102.

If the optional contact electrode is not implemented, the other longitudinal end of the microirradiator 100 can be left as-is. In this manner, the other longitudinal end of the platinum wire electrode 104 can be directly coupled to an electrical source. If greater stability is desired, the other end of the capillary tube sheath 102 with the platinum wire electrode 104 therethrough can be sealed and/or pulled.

If the optional contact electrode is implemented, it can be coupled to the platinum wire electrode 104 either within the sheath 102, outside of the sheath 102, at the end of the sheath 102, or a combination thereof. For example, at least a portion of the contact electrode can be placed inside of the capillary tube sheath 102, followed by filling at least a portion of the void space (defined as the volume between the inner cross-sectional dimension of the sheath 102 and the space occupied by the platinum wire electrode 104 and the contact electrode) with a conductive epoxy 108 to electrically couple the platinum wire electrode 104 to the contact electrode. Next, if desired, the other end of the capillary tube sheath 102 with the platinum wire electrode 104 and contact electrode therethrough can be sealed and/or pulled for greater stability.

It should be noted that the portion of the contact electrode that extends beyond the end of the insulating sheath 102 can have its own insulating sheath (not shown). For example, if the contact electrode is a copper wire, it can be an insulated copper wire, with at least a portion of the insulation removed to electrically couple the copper wire with the platinum wire electrode 104.

The radioactive source 106 can be disposed on the first longitudinal end of the platinum wire electrode 104 via electroplating. First an electroplating solution can be formed from a salt containing the radioactive source materials, which in the case of the microirradiator shown in FIG. 1 is an elemental radioisotope such as Ni-63. The pH of the electroplating solution can be adjusted according to the Pourbaix diagram for the particular elemental radioisotope. Other additives can be added to the electroplating solution in order to optimize the quality of the electroplated elemental radioisotope. Such additives would be known to those skilled in the art to which this disclosure pertains.

Once the electroplating solution containing the elemental radioisotope is prepared, the electroplating process can begin. The choice of standard and counter electrodes, as well as other electroplating parameters, can be determined by those skilled in the art to which this disclosure pertains without undue experimentation. For example, those skilled in the art could readily adjust the temperature of the electroplating solution, the voltage applied, the type of voltage (e.g., pulsed or continuous), and the like, in order to obtain the desired coating of the radioactive source 106 on the platinum wire electrode 104.

The thickness of the radioactive source 106 can be controlled by monitoring the potential of the electrodes during electroplating. Preferably, the thickness of the layer of the radioactive source 106 is greater than the threshold thickness for which self-absorption of the radiation particles occurs. In this manner, the amount of radiation that is emitted from the radioactive source 106 is maximized.

In some circumstances, this level of thickness may be too small. If this is the case, but a thicker amount of the elemental radioisotope may be too cost prohibitive, the electroplating solution can include a mixture of both the elemental radioisotope and a non-radioactive or "cold" form of the element. In this manner, the thickness of the radioactive source layer 106 can be increased, while still maximizing the amount of radiation emitted from the radioactive source 106.

It is important to note that, when the optional contact electrode is implemented in the microirradiator 100, the electroplating step can occur before or after the implementation of the contact electrode.

Figure 2:
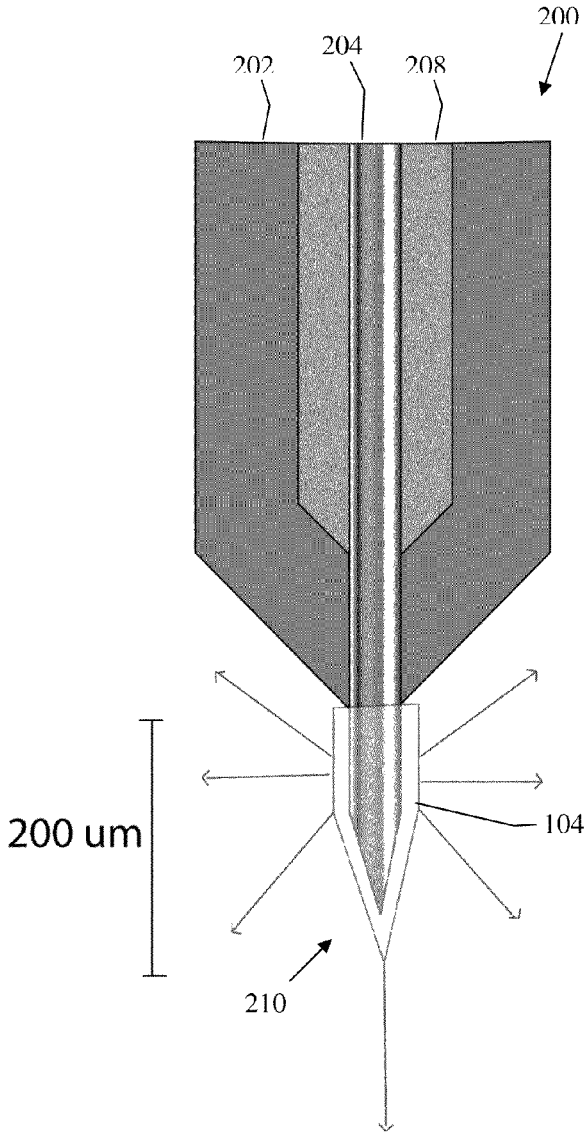
FIG. 2 is a schematic illustration a cross-section of a portion of another exemplary microirradiator in accordance with some embodiments of the present invention.

Reference will now be made to FIG. 2, wherein an exemplary microirradiator, in accordance with some embodiments of the present invention, is illustrated. The exemplary microirradiator is generically designated by reference numeral 200. This type of microirradiator is suitable for irradiating an internal portion of a target sample.

The microirradiator 200 includes an insulating sheath 202, which is formed from a glass capillary tube. Disposed within the glass capillary tube sheath 202 is the non-radioactive conducting electrode 204, which is formed from a gold wire. The radioactive source 206, which is an elemental radioisotope such as sulfur, is disposed at one longitudinal end of the gold wire electrode 204. This longitudinal end of the gold wire electrode 204 extends beyond the surface of the insulating sheath 202 at the same longitudinal end of the insulating sheath 202 so as to create a protruding tip or probe 210. At least a portion of the probe 210 can be injected into a target sample so as to emit radiation in various directions from the surface of the radioactive source 106 that is disposed on the probe 210.

The length (along the longitudinal axis) of the gold wire probe 210 in the microirradiator 200 shown in FIG. 2 is about 200 micrometers. This specific size is shown only by way of example and is not intended to be limiting. Thus, as would be understood by those skilled in the art to which this disclosure pertains, the gold wire probe 210 can have any length that would be appropriate injection into the target of the radiation.

As with microirradiator 100 in FIG. 1, the cross-sectional dimension of the gold wire electrode 204 in the radiation device 200 shown in FIG. 2 is not as large as the inner cross-sectional dimension of the insulating sheath 202. This void space can be occupied by the optional contact electrode (not shown) or by the chemical or mechanical link between the non-radioactive conducting electrode 204 and the optional contact electrode. In the microirradiator 200 of FIG. 2, the void space is occupied by a conducting epoxy resin 208, which is used to chemically couple the non-radioactive conducting gold wire electrode 204 and the optional contact electrode.

Similarly, the insulating sheath 202 can extend to the other longitudinal end of the non-radioactive conducting electrode 204 (i.e., the end opposite to that where the radioactive source 206 is disposed), such that the contact electrode only extends beyond the end of the insulating sheath 202. In this case, the contact electrode can be coupled to the non-radioactive conducting electrode 204 at least partially inside the insulating sheath 202, as shown in FIG. 2; or the contact electrode can be coupled to the non-radioactive conducting electrode 204 only at the longitudinal end of the non-radioactive conducting electrode 204.

Alternatively, the insulating sheath 202 can extend beyond the other longitudinal end of the non-radioactive conducting electrode 204, such that at least a portion of the contact electrode also extends into the insulating sheath 202. In such cases, the contact electrode is coupled to the non-radioactive conducting electrode 204 entirely inside the insulating sheath 202.

Finally, in some cases, the other longitudinal end of the non-radioactive conducting electrode 204 extends beyond the same longitudinal end of the insulating sheath 202. In such cases, the contact electrode can be coupled to the non-radioactive conducting electrode 204 outside of the insulating sheath 202. It should be noted that if a portion of the contact electrode also extends into the insulating sheath 202, then the contact electrode can also be coupled to the non-radioactive conducting electrode 204 at least partially inside of the insulating sheath 202.

The microirradiator 200 of FIG. 2 can be fabricated in a similar fashion as the microirradiator 100 of FIG. 1, with the exception that the first longitudinal end of the non-radioactive conducting electrode 204 extends beyond the same longitudinal end of the insulating sheath 202 so as to create the probe 210 on which the radioactive source 206 material will be electroplated.

Once the various microirradiators of the present invention, regardless of whether they are suitable for irradiating an internal or external portion of a target sample, are fabricated, they can be implemented as desired. In general, during operation of these microirradiators, the non-radioactive conducting electrode or the optional contact electrode is electrically coupled to an electrical source, which is used to provide a current to the radioactive source in order to effect the emission of radiation from the radioactive source to the specified target.

The microirradiators of the present invention can be used in a variety of applications. These include, for example, radiobiology experiments, radiotherapy, integrated circuit device diagnostics, and any other application in which a compact irradiator that produces low absolute radiation levels is needed.

By way of illustration, the microirradiators can be used in radiobiology experiments wherein low doses of localized radiation to biological samples are desired. Specific experiments that can be carried out include bystander effect and/or adaptive response experiments in which the biological samples' responses to various sources of radiation (e.g., alpha particles, beta particles, gamma particles, and the like) are observed.

For example, a microirradiator as disclosed herein can be used to introduce irradiation that results in DNA double-strand breaks in cell nuclei. A photo-stable tag attached to a specific DNA repair protein can be used to observe the double-strand breaks as foci appearing inside the nucleus of a cell. These foci can be observed and quantified over time. This type of experiment can involve positioning the microirradiator over the biological cell sample, which is contained in a sample chamber of an optical microscope (e.g., a deconvolution or confocal microscope), followed by irradiating the sample using the microirradiator. The microscope can then be used to monitor and/or measure the kinetics of the DNA repair process.

By way of another illustration, the microirradiators can be used for radiotherapy, wherein the DNA of cells is damaged by the irradiation in order to modify the cell characteristics. One particularly useful radiotherapeutic application of the microirradiators of the present invention is in internal radiotherapy or brachytherapy, which is commonly used to treat cervical, prostate, breast, and skin cancer, and can also be used to treat tumors in other body sites.

Another illustration of the use of the microirradiators of the present invention involves electronic devices. That is, the microirradiators can be used in integrated circuit device diagnostic processes. Specifically, the microirradiators can serve as a testing probe to determine whether a particular integrated circuit device component is vulnerable to radiation.

EXAMPLES

The present disclosure is further exemplified by the following non-limiting examples.

Example 1

Ni-63 Microirradiators

In this example, two types of microirradiators were fabricated. The microirradiators were prepared with the low-β-energy radionuclide Ni-63 electrodeposited onto a 25 micrometer (μm) diameter platinum wire. The first type of microirradiator, termed a "recessed disk" microirradiator was similar to that shown in FIG. 1. The second type of microirradiator, termed a "protruding wire" microirradiator was similar to that shown in FIG. 2.

Since Ni-63 is a pure low-energy β emitter (Emax=67 keV), it is easily shielded by a few micrometers of glass and can be electrochemically deposited from a so-called "Watts bath." Because of the low-energy β's of Ni-63, the recessed disk electrode shielded by the surrounding glass yielded a built-in collimated beam, with β electrons being delivered only to the irradiated target. Additionally, Ni-63 electroplated onto the protruding wire of a microcylinder electrode can be implanted into a cell, leading the cell to absorb the total flux of activity from the device. It is important to note that the dose at these amounts of radiation is high on a cellular level, but the dose to the operator is minimal. Thus, at the distance of 1 centimeter (cm) from the tip of each microirradiator, the radiation intensity is zero. Therefore, these devices can be used without substantially any risk to the user.

All chemicals used in fabrication, characterization, and electrodeposition of the microirradiators involved chemical reagent grades of ACS or higher unless specified. All aqueous solutions were prepared using water from a Purelab Ultra water purification system (18.2 MΩ·cm).

All experimentation handling HF and radioactive materials require safety precautions. HF should be used in a hood with proper protective clothing due to the severe toxicity of the acid. Those possessing and using radioactive materials must follow safety guidelines provided by the user's workplace.

The electroplating solutions were prepared as follows. The radiotracer Ni-63 stock solution was purchased from NIST (National Institute of Standard and Technology) as 5 mL of a solution of $63NiCl_2$ in 0.9 M HCl, 2.22 MBq total activity. In order to correlate deposited amount of Ni (ng) to its activity (Bq), a modified "Watts bath" was prepared as described. An experimental "cold" standard (i.e., one that was not radioactive) was used for testing the efficiency of Ni plating. Amounts of 25 mg of "cold" $NiCl_2 \cdot 6H_2O$, 30 mg of $K_2SO_4$, and 1 mL of 1 M $H_3BO_3$ were added to the "cold" standard. This same "cold" solution described was followed for Ni-63 standard, with a specific activity of 59.2 kBq/g. During plating the bath was heated to 60° C. The pH of the solution was kept constant by dropwise addition of water and dilute HCl or NaOH, respectively. A pH of 4 was maintained during deposition, which was optimal, according to a Pourbaix diagram, for the highest efficiency.

All liquid scintillation measurements were taken using a Perkin-Elmer Pacard TriCarb 2900TR detector with National Diagnostics LS-275 water-soluble liquid scintillation cocktail with the detection efficiency for Ni-63 of 70%. All count rates were corrected for the values measured the background sample. All microirradiators were taped to a liquid scintillation vial in the same configuration to ensure no statistical deviations due to positioning. Considering the quenching by the material of the microirradiator, the background samples were counted in the same manner (with a microirradiator with cold Ni).

All electrochemical characterizations of the electrodes before and after etching utilized a Princeton Applied Research potentiostat/galvanostat 273 A. The potentiostat was interfaced to a PC computer, and all voltammetric data was acquired through CView and CWare v 2.8d electrochemical software programs (Scribner Associates, Inc.). Electrochemical characterizations of the deposition of radioactive materials used a portable OMNI 90 potentiostat interfaced to a PC through a National Instruments NI-DAQ 6008 card. All voltammetric data testing the cold deposition and radioactive deposition of Ni were analyzed through LabVIEW version 8.5.

Fabrication of the recessed disk structure began by sealing the platinum wire in 0.5 cm bore diameter borosilicate glass capillaries (Sutter Instruments, CA). A 3 cm piece of the 25 μm Pt wire was threaded through the capillary and flame-sealed at the end for stability. Each sealed capillary was pulled in a glass electrode pulling apparatus (Narshige model pp-880, Japan) at 800° C. with a pull length of 3 cm. The end of the pulled Pt wire in glass was then polished with varying grades of sand paper and alumina polish (9-1 μm diameter, Buehler Scientific, Inc.) producing a smooth disk. Copper wire with silver epoxy (Epotek Scientific, Inc.) was used to prepare the contact electrode. Finally, the structure was sonicated in water for 10 min and heated at 150° C. for 15 min. The contacted microelectrodes were then cycled in 2.5 mM ferrocene (Fc) (Acros Organics, 99%), 0.1 M tetrabutylammonium perchlorate (TBAP) (Alfa Aesar, electrochemical grade) in acetonitrile (CH3CN) (Acros Organics, ACS grade) at 20 V s−1, to verify the electrochemical preparation.

Figure 3:
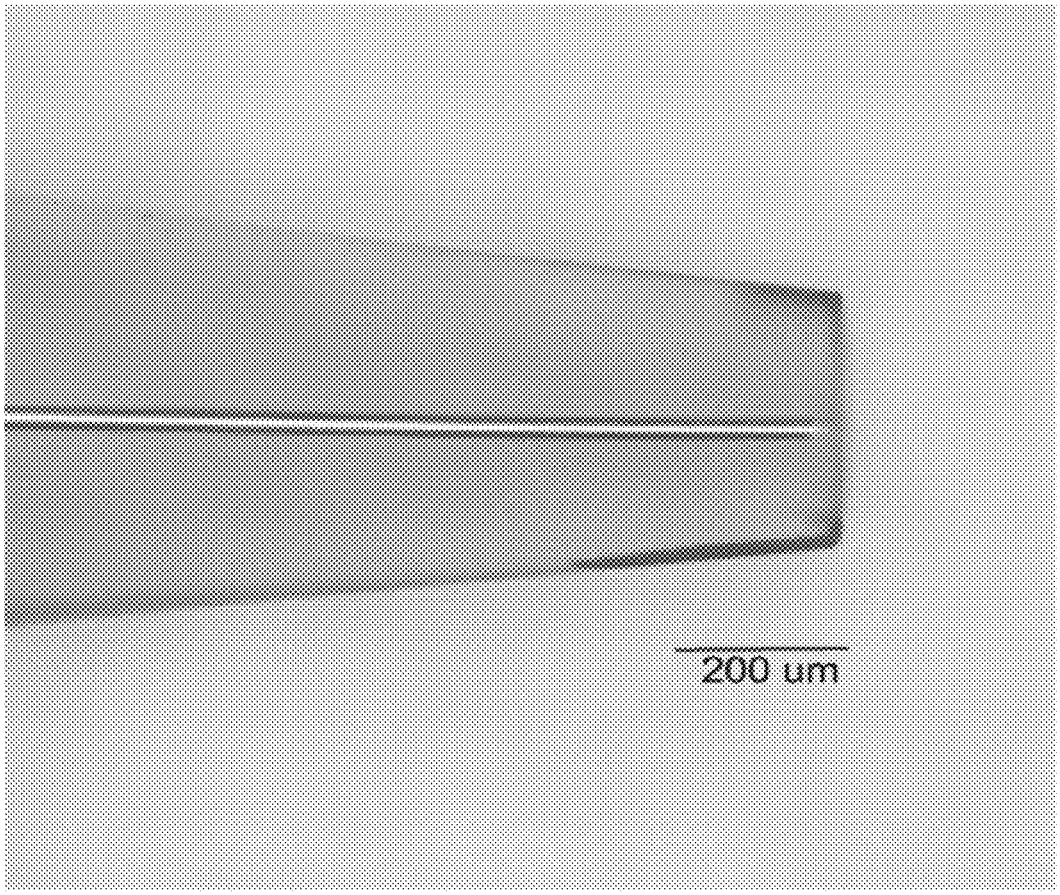
FIG. 3 is an optical micrograph image of a recessed disk-type microirradiator in accordance with EXAMPLE 1.

The recess or channel was formed as follows. After ensuring electrical contact, each structure was placed in a saturated $NaNO_2$ (Alfa Aesar, ACS reagent grade) solution and etched for 20 s at −9 V versus a Pt auxiliary, Ag/AgCl (1 M KCl). This procedure enabled a channel depth of approximately 30-40 μm of platinum within the structure, with deeper channels attained at longer etching times. The recessed disk structures were then sonicated in water and acetonitrile. FIG. 3 is an optical micrograph image of the recessed disk structure.

In order to ensure the etching back of the Pt took place, the electrodes were cycled in 2.5 mM Fc solution at varying scan rates from 20 to 200 mV s−1 as previously described. The cyclic voltammograms of FIG. 4 indicate a drop in current after etching back the Pt in the glass. Furthermore, at faster scan rates, the cyclic voltammograms showed characteristic planar diffusion properties, which is a result of the analyte being confined to the channel during cycling.

Fabrication of the protruding tip structure began by sealing a 25 μm Pt/Ir wire (90:10) in 0.5 cm bore diameter borosilicate glass capillaries. The sealed Pt wire in the glass capillaries were pulled, contacted, and heated following the same procedure as described above.

Figure 5:
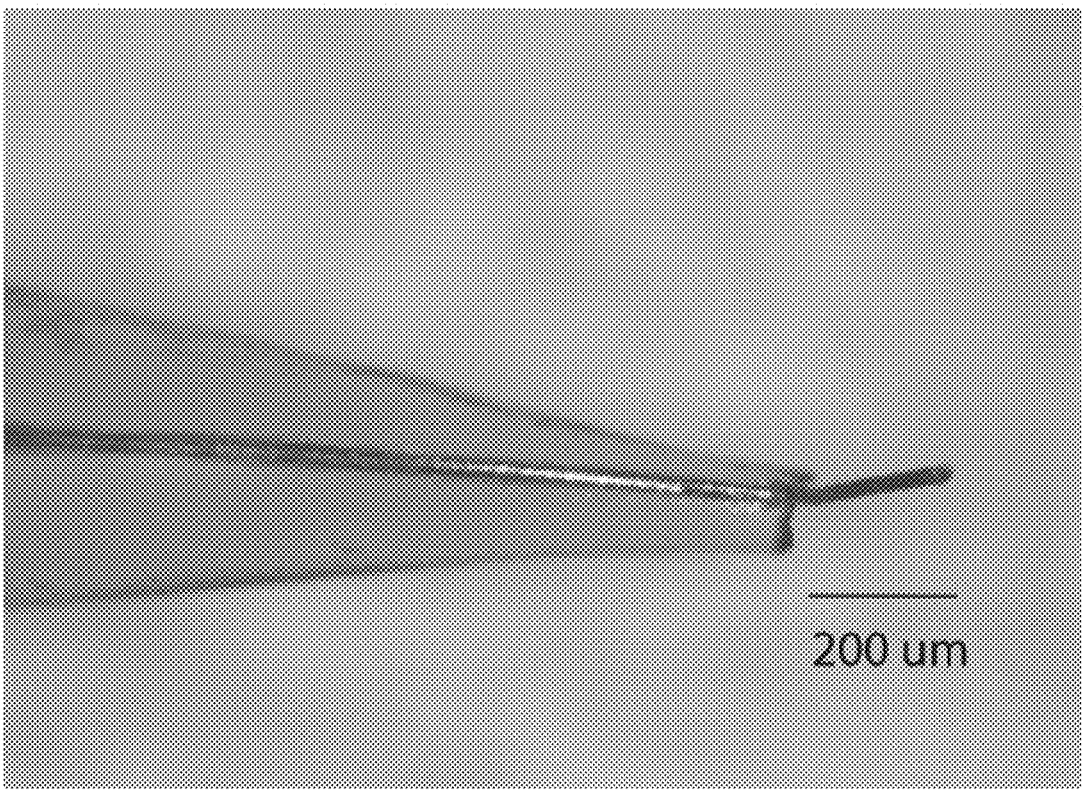
FIG. 5 is an optical micrograph image of a protruding tip-type microirradiator in accordance with EXAMPLE 1.

The tip of the pulled Pt/Ir wire in glass (approximately 500 μm) was dipped into concentrated HF in a hood by dipping the electrode into the bath until it barely touched the surface to remove the glass surrounding the Pt/Ir wire tip. After etching, each was rinsed thoroughly with water and acetonitrile. This procedure removed approximately 500-800 μm of the glass. The exposed wire was then trimmed to approximately 200 μm in length. An optical micrograph image of this structure is shown in FIG. 5.

Figure 6:
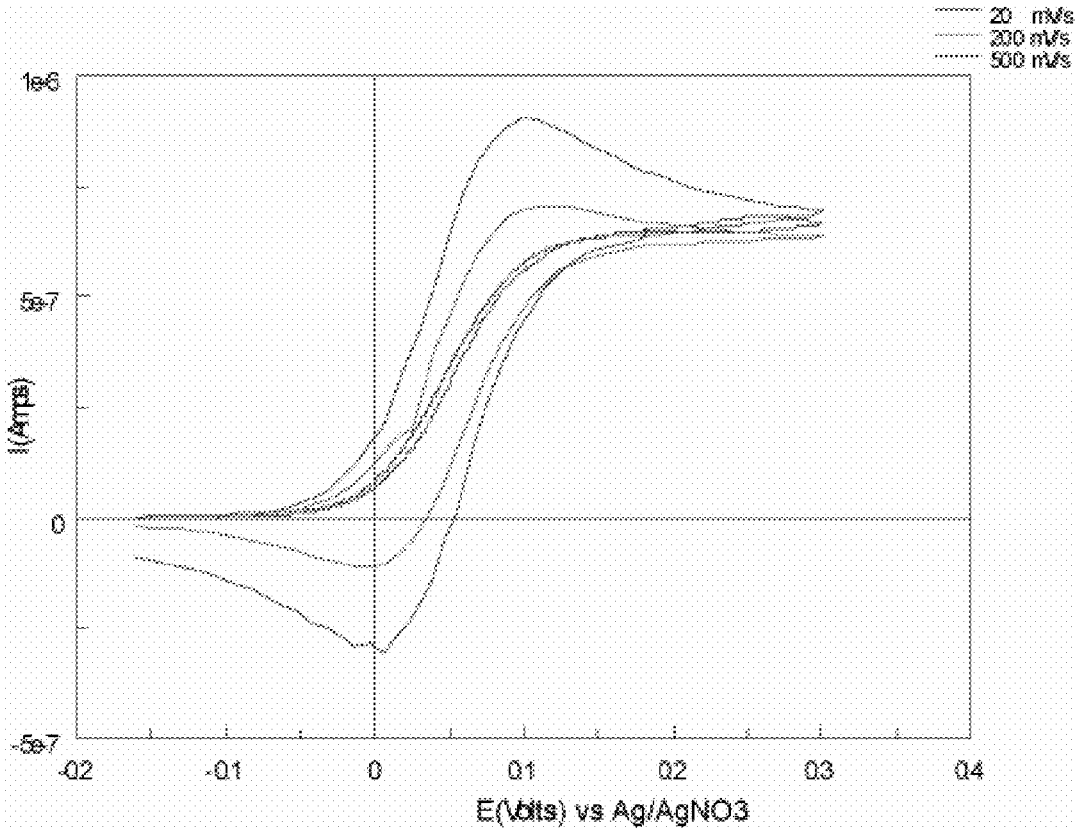
FIG. 6 includes voltammetric responses of 25 μm diameter, 200 μm long protruding tip-type structures in accordance with EXAMPLE 1.

Following the same procedures described above, cyclic voltammograms (FIG. 6) were taken to ensure the electrochemical contact. As shown in FIG. 6, the cyclic voltammogram of the protruding wire microirradiator shows microcylinder voltammetry characteristics, with the radial diffusion component dominating at slower scan rates (<20 mV s−1). At higher scan rates (>20 mV s−1), the planar diffusion down the length of the cylinder dominates.

To manufacture each type of microirradiator, radioactive metallic Ni was electroplated within the channel on the surface of the recessed Pt wire, or on the protruding Pt wire, respectively. Electroplating provided stability of the Ni-63 needed to deliver the radiation doses to the target without flaking off into the rest of the sample. Experimentally, a nonradioactive ("cold") Ni standard was made to test the current efficiency and deposition techniques of both types of microirradiators. The Watts bath is a well-known electrochemical plating solution for the deposition of Ni for industrial purposes. Typically, the Watts bath is composed of $SO_4^{2-}$ anions in the form of $NiSO_4$ for strength, $Cl^-$ anions as $NiCl_2$ for plasticity, and $H_3BO_3$ to inhibit hydrogen evolution at far negative potentials. Since the radioactive source is a standard $^{63}NiCl_2$ in 0.9 M HCl, a cold equivalent standard of this exact solution was prepared in order to optimize experimental conditions. The addition of 25 mg of $NiCl_2$ and 30 mg of $K_2SO_4$ to the 5 mL NIST Ni-63 source provides both the Ni needed for efficient electrochemical deposition of Ni and the sulfate anion needed for the strength in deposit. Other modified Watts bath have been reported, but to our knowledge, this is a new method of preparing Ni-63 for electroplating. All electrochemical experiments were performed in a 5 mL nickel cup serving also as the auxiliary electrode. The reference and working electrodes were suspended vertically in the solution, with the entire setup maintained at 60° C. for optimum deposition efficiency. This same procedure was applied with the radiolabeled $^{63}NiCl_2$ standard. To deposit Ni onto each microirradiator, both the protruding wire and recessed disk microirradiators were sonicated in Ni electroplating solution for 1 min to saturate potential adsorption sites on the glass and to ensure solution is in contact with the electroactive surface. The microirradiators were suspended in the Ni solution within the counter electrode Ni-cup and held at −0.775 V versus Ag/AgCl (1 M KCl). From the charge passed during the deposition, the mass (grams) of Ni was calculated using Faraday's Law, m=QM/nF, where m=mass (g), Q=charge, M=molecular weight, n=number of electrons, and F=Faraday's constant.

Figure 7:
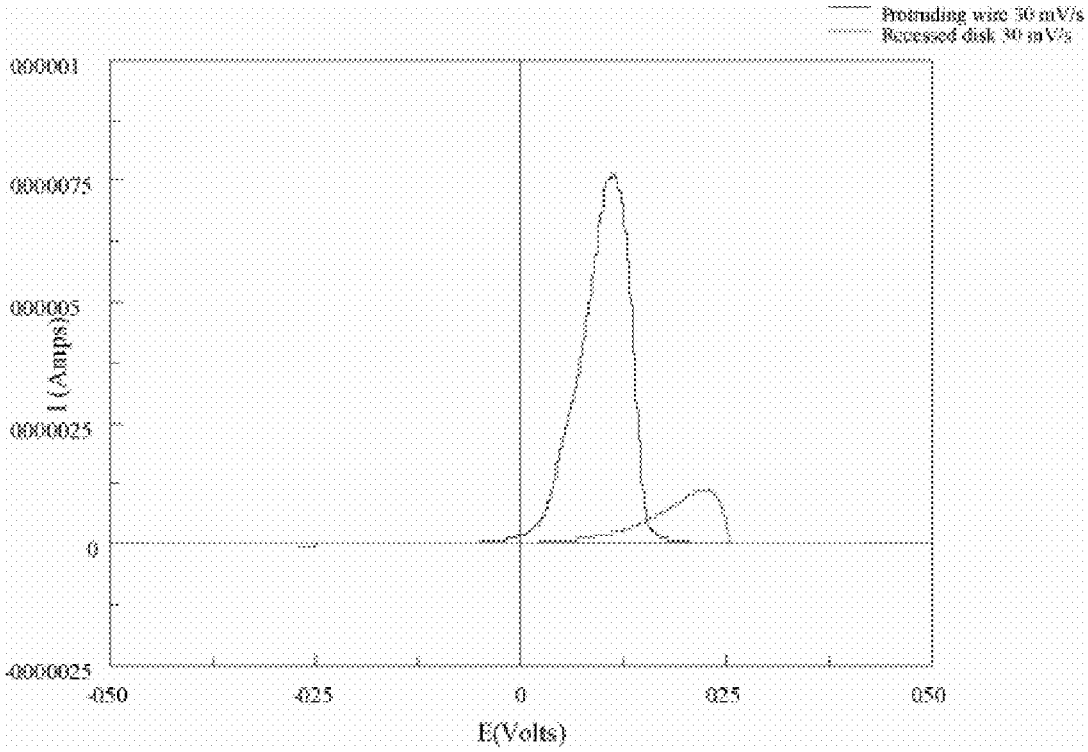
FIG. 7 includes anodic stripping analysis of Ni protruding tip-type and recessed disk-type microirradiators in accordance with EXAMPLE 1.

In order to verify the amount of deposited Ni, the microirradiators underwent electrochemical anodic stripping. Therefore, each microirradiator deposited with cold Ni was transferred to a 1 M NaCl aqueous solution, pH=2, and cycled from −0.3 to 0.8 V at 20 mV s−1. As shown in FIG. 7, oxidation peaks for both the recessed disk and protruding wire are indicative of Ni oxidation, with a standard potential of 0.259 V versus a standard hydrogen electrode (SHE). The two oxidation peaks having different geometries and peak voltages (Ep) are indicative of the geometry of the electrode and fit well with conventional theory. To calculate the current efficiency, charges from both oxidation stripping peaks and deposition were calculated by efficiency=$Q_{stripping}/Q_{deposition}$, where Q is charge. This process helped determine how much of the charge passed during deposition is toward Ni deposition versus other competing processes (i.e., reduction of hydrogen). The current efficiency of Ni on both the recessed disk and protruding wire electrodes was high, ranging from 70% to 90% for each electrode on both a portable and conventional potentiostat. This current efficiency was imperative in determination of the activity of Ni-63 deposited and can be correlated with the specific activity of the source.

Figure 8A:
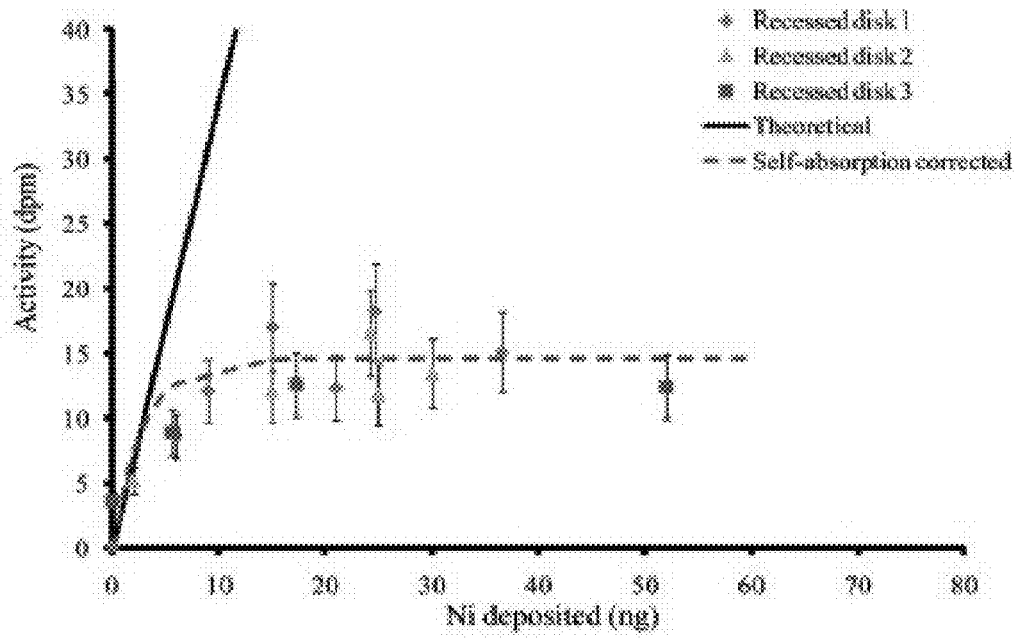
FIG. 8 includes experimental, theoretical, and self-absorption-corrected activity (dpm) vs Ni deposited (ng) for (A) recessed disk-type and (B) protruding tip-type microirradiators, wherein errors in activity values range ±20% with all activity measurements background-corrected, in accordance with EXAMPLE 1.
Figure 8B:
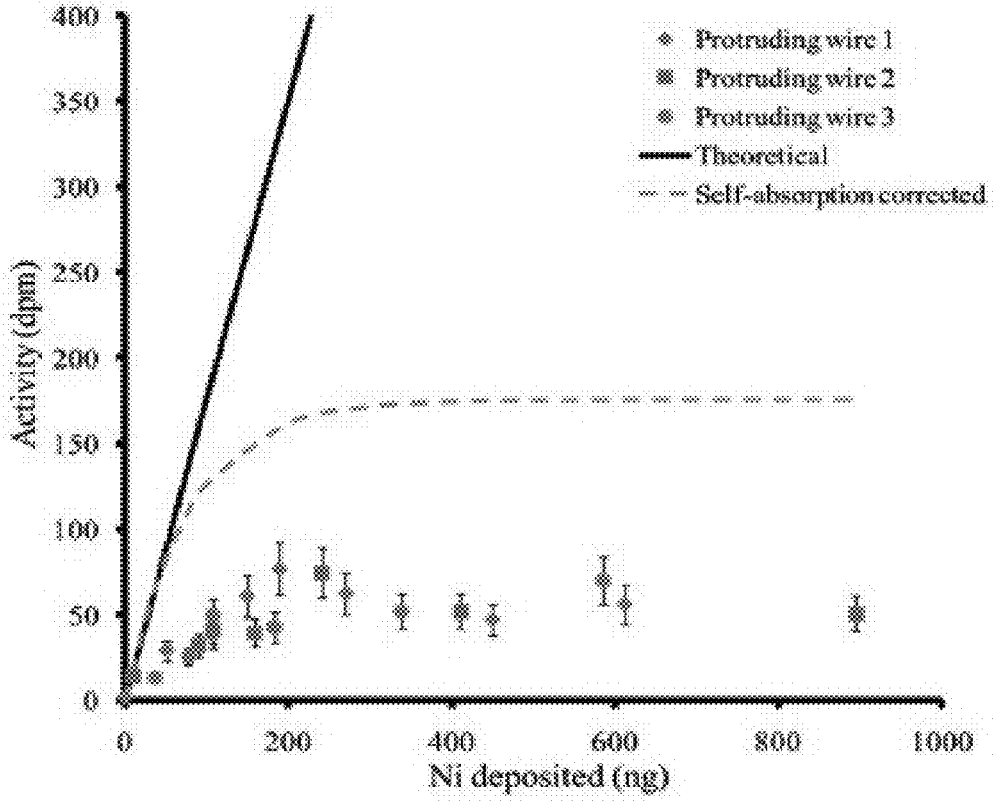

With the NIST Ni-63 standards, several trials were taken with three of each kind of microirradiator following the procedures described above. Counting performed previously ensured that no residual radioactive materials were adsorbed on the electrode body after electrochemical deposition and anodic stripping. Each electrode was deposited with different amounts of Ni and fastened into a liquid scintillation vial to minimize the optical shielding effects during the liquid scintillation counting. After each measurement, the microirradiator was removed from the cocktail, rinsed, and soaked in water for 20 min to minimize the effects of the cocktail on the electrochemical stripping. The exact amount of Ni on each electrode was determined by anodic stripping analysis and correlated with the measured activities of Ni-63. As shown in FIG. 8, parts A and B, for both the recessed disk and protruding wire microirradiator, activity increases linearly with amount of Ni-63 until leveling off, due to self-absorption of the low-energy-emitting β's. For the recessed disk microirradiator, activity detected by liquid scintillation leveled off at approximately 15±3 disintegrations/min (dpm) (FIG. 8A), corresponding to 0.25±0.5 Bq. Taking into consideration that this source was confined to a surface area of $4.9\times10^{-6}$ cm$^2$, the flux density shown from each recessed disk microirradiator was approximately $5.1\times10^4$ Bq/cm$^2$. Additionally, the activity of the protruding wire microirradiator leveled off at approximately 60±12 dpm (FIG. 8B), corresponding to 1±0.2 Bq total activity detected. These higher activity values were achieved because of the larger surface area of the wire versus the recessed disk, enabling more Ni-63 to be deposited across the surface. With this being said, the flux density for each protruding wire electrode shown was approximately $1.1\times10^4$ Bq/cm$^2$.

Additionally, at the point of deviation from linearity on the graph, the recessed disk and protruding wire electrode clearly show self-absorption effects at 10 and 200 ng, which correlate to 2.29 and 2.24 μm (d=8.9 g/cm$^3$) in thickness, assuming uniform thickness. This agreed well with self-absorption and thickness of deposit values reported in the literature. This, once again, assumes that each deposit was uniform in morphology and density at 8.9 g/cm$^3$. Morphology of the deposited layers could ultimately vary the activity data shown.

An analysis of the Ni-63 flux from recessed disk and protruding wire electrodes follows. The amount of radiation detected from any point source is defined from the strength of the source and its geometrical configuration with respect to the object of irradiation. To estimate the total amount of radiation emitted from each device (Bq) and its density, a theoretical calculation of the flux density (Bq/cm$^2$) was done for each type of microirradiator. Since Ni-63 is a low-energy β-emitting material, its flux is limited in the fact that there is a maximum β particle output due to self-absorption within the source already at very low thicknesses (micrometers).

In this hypothetical calculation and for simplicity, a 1 μm deposit of Ni-63 was used as the thickness of the source. This produced a disk of Ni, 1 μm high, 12.5 μm radius, and a surface area of $4.9\times10^{-6}$ cm$^2$. If the Ni-63 was a disk source, only the surface area of the disk proximal to the irradiated object will be relevant due to the shielding effects of the surrounding glass and of the Pt wire. The ratio of the flux through the exposed proximal surface of the disk to the total surface area activity of the disk source will define the geometry factor $f_G$, i.e., how much activity is emitted from the proximal surface area of the Ni disk source as follows:

$$f_g = S_p / S_t = \frac{\Pi r^2}{2\Pi rh + 2\Pi r^2} = \frac{r}{2h + 2r} \tag{1}$$

This equation demonstrates that with increasing amounts of Ni deposited, the height of the disk increases. With increasing height, the radius of the disk source remains the same, causing the shielding factor to decrease with increasing deposits. It is important to note that, for simplicity, the Ni-63 source has been shown as a disk (r<<h), assuming that the non-collimated radiation is completely shielded. To illustrate this, a Ni-63 disk source with r=12.5 μm, h=1 μm would have a shielding factor of 46%. Applying the backscattering factor of 1.5 for Pt (equivalent to Au backscattering factor) yields an additional 23% β flux from the source. With this being said, only about 69% of total β radiation from the deposited radioisotope would be (ideally) emitted at the proximal end at this height.

To estimate the amount of radiation emitted from the protruding wire microirradiator, the mass of the deposit of Ni on the wire can be similarly calculated by the same method described above, taking into consideration the change in geometry of the wire. The geometrical shape of the Ni source on the wire will be that of a hollow cylinder, with geometry where h=height of deposit, r=radius of internal cylinder (12.5 μm), and R=radius of external cylinder. Taking this into consideration, the surface area of the proximal face ($S_{pf}$) of the hollow cylinder is exposed to the specimen and the distal face on top of the Pt/Ir wire backscatters into the wire, with the top scattering into the glass. This translates to 50% of β particles emitted.

$$f_g = S_{pf} / S_{hc} = \frac{\Pi Rh + \Pi rh + (\Pi R^2 - \Pi r^2)}{2\Pi Rh + 2\Pi rh + 2(\Pi R^2 - \Pi r^2)} = 0.5 \quad (2)$$

Unlike the recessed disk irradiator, the thickness, h, of the Ni deposit on the wire increases proportionally with the radius of the external cylinder, causing the shielding factor be constant. Taking into factor the backscattering coefficient 1.5 for Pt, an additional 25% percent of radiation will be emitted for a total of 75%. However, as mentioned above, the weak energy β particles are partially attenuated in their specimens, and Ni-63 has an attenuation coefficient of 1.56 mg/cm$^2$, so there will be a value of d at an infinite thickness, $d_\infty$, determined from the saturation limits in FIG. 8, parts A and B. As mentioned above, Ni-63 once again has self-absorption limitations, so for these calculations $f_G$ at infinite thickness must be calculated as well, according to experimental data.

The theoretical activity levels $A_t$, deposited on each microirradiator, is calculated from the deposited amount of Ni element determined experimentally by electrochemical stripping, and the specific activity of the Ni-63 radioisotope:

$$A_t = mA_{sp} \quad (3)$$

where $A_t$ is the theoretical activity in Bq or dpm, m is the mass of nickel in grams, and $A_{sp}$, is the specific activity of Ni-63 in Bq/g.

The theoretical activity levels $A_t$, possibly emitted from each microirradiator, is calculated from the deposited amount of Ni element determined experimentally by electrochemical stripping, the specific activity of the Ni-63 radioisotope, and their geometry as discussed above:

$$A_t = f_g A_{sp} \quad (4)$$

where $A_t$ is the theoretical activity in Bq or dpm, m is the mass of nickel in grams, $A_{sp}$ is the specific activity of Ni-63 in Bq/g, and $f_G$=0.69 and 0.75 are the geometry factors for the recessed disk and protruding wire, correspondingly.

Figure 4:
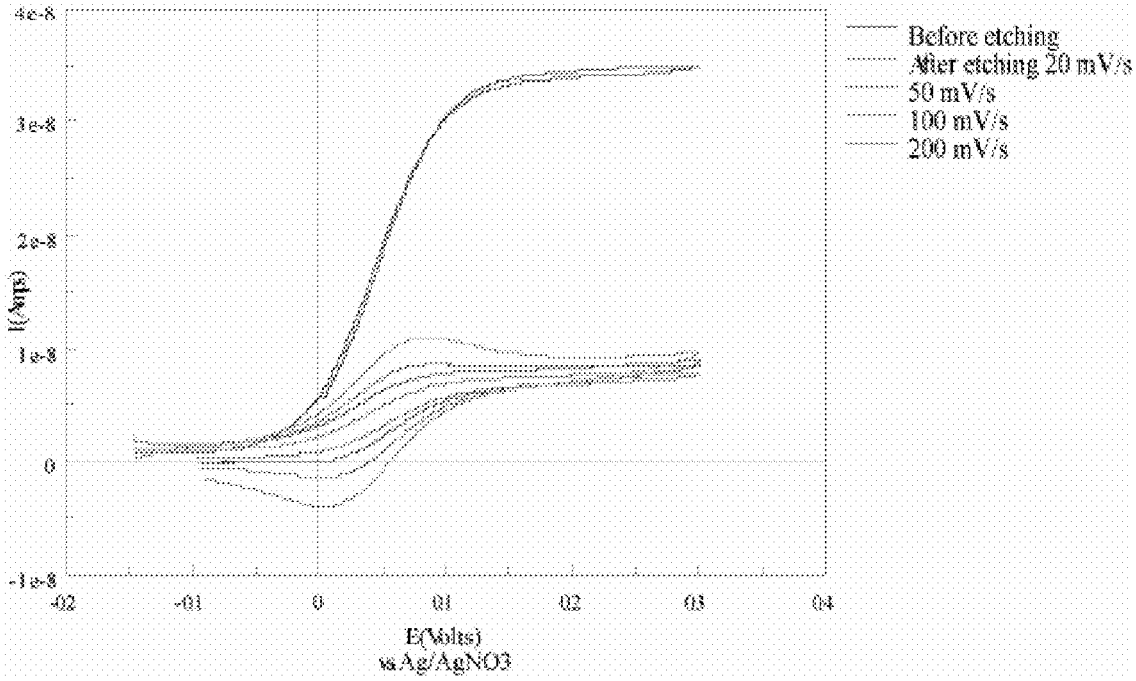
FIG. 4 includes voltammetric responses of 25 μm recessed disk-type structures before and after electrochemical etching in accordance with EXAMPLE 1.

To illustrate this, parts A and B of FIG. 8 show theoretically derived activity values with and without self-absorption corrections. The straight lines represent the calculated theoretical values without self-absorption for the recessed disk and protruding wire, respectively. To model theoretical activity levels with geometrical shielding factors of the microirradiators and self-absorption corrections, follows $$A = [A_\infty(1 - e^{-\mu d})]S_\infty \quad (5)$$

where A is the absolute activity (in dpm), $A_\infty$ is the measured "saturated" activity at an infinite thickness of the specimen as determined from FIG. 4, parts A and B, μ is the absorption coefficient for the isotope (Ni=1.58 cm$^2$/mg), d is the range, or "density thickness" as used in radiological terms in mg/cm$^2$, and $S_\infty$ is the shielding factor (eqs 3 and 5) at infinite thickness.

The activity and shielding factors at infinite thickness are taken at 10 and 100 ng for the recessed disk and protruding wire, where the saturation of Ni-63 begins. Theoretical levels of the emitted activity were calculated from the mass deposited times the specific activity in Bq/g (eq 6). Taking this into consideration, the recessed disk model (red) fits excellently with experimental data, averaging 14 dpm (0.23 Bq) within ±1% of values shown in FIG. 8A. The activity of the protruding wire microirradiator levels off at approximately 60±20 dpm. For the protruding wire model, however, it is higher than experimentally observed, but this, we assume, could be due to the fact that the body of the electrode placed in the vial quenched a significant amount of the photon output, thus limiting the detector efficiency.

Since both types microirradiators can be utilized for the irradiations of cells, the range of the β's in water and tissue must be addressed. At ⅓$E_{max}$ (17 keV), the range of β electrons in water is 4.79 μm and 0.372 cm in air. Additionally, estimates of expected dose to the tissue (Gy/min) are essential for future biological work. To calculate dose rate $$D_\beta = 5.768\times10^{-5}\Phi_\beta E\mu e^{-\mu(\rho x)} \quad (6)$$

where Φ is the flux of β's in Bq/cm$^2$, E is one-third of the maximum energy of the β particle (⅓$E_{max}$), μ is the absorption coefficient of radionuclide in deposition material (cm$^2$/g), ρ is density of the deposition material in g/cm$^3$, and x is thickness in cm. Assuming the recessed disk and protruding wire electrodes have activities of 11 and 51 Bq/cm$^2$, respectively, each flux of β electrons would be 2.04 and 1×10$^5$ Bq/cm$^2$. Using each individual flux value and absorption coefficients in tissue leads to a direct dose of 0.071 and 0.035 Gy/min to individual cells for the recessed disk and protruding wire microirradiator, respectively. This gives the theoretical dose rate of the source of radiation without taking into consideration any shielding absorption from air or any other encountering material. Realistically, both the protruding wire and recessed disk microirradiators will be mounted at a 45° angle, with the tip being placed anywhere between 5 and 10 μm away from the cells. Modifying eq 6, the new dose rate calculation is $$D_{\beta,T} = D_\beta e^{-\mu_\beta(\rho x)} \quad (7)$$

where $\mu_\beta$ takes into consideration the shielding effects from the distance the β's have to travel through the extracellular matrix, consisting of mostly water. As shown in Table 1, placement of the microirradiator with respect to the cell is crucial of the dose the cell receives. Additionally, the thickness of each cell is important to maximize DNA damage and hydrolysis within the cell. With a stopping power of 14.9 MeV cm$^2$/g, and an average range of 4.79 μm, thin cells risk the probability of radiation scattering through the cell into surrounding medium. Different distances between the radioactive source and the cell are crucial in dose rate calculations through water, since its limiting distance is approximately 60 μm. Optimally, placing the microirradiator as close to the cell as possible would be the optimal configuration for the application of the highest dose rate.

TABLE 1

Estimated dose rates at different distances from the cell of both microirradiators.

| Type of Microirradiator | Flux, $\Phi_\beta$ (B/cm$^2$) | Direct Dose to cell (Gy/min) | Penetration Depth in $H_2O$ 5 μm | 10 μm | 20 μm |
|---|---|---|---|---|---|
| Protruding wire | $1.00 \times 10^5$ | 0.035 | 0.029 | 0.024 | 0.01 |
| Recessed desk | $2.04 \times 10^5$ | 0.071 | 0.059 | 0.049 | 0.03 |

To summarize, the activity levels of Ni-63 emitted from the recessed disk and protruding wire are 0.25 and 1 Bq, respectively. The corresponding β particles flux levels emitted from the recessed disk and protruding wire are 51 and 11 kBq/cm2, respectively. These values, measured experimentally using liquid scintillation counting, fit very well the expected values of activity for each microirradiator, calculated considering the self-absorption effect, typical for low-energy β particles. In order to determine the optimal configuration the dose rates for varying distances from the object were calculated.

Example 2

Radiobiological Implementation of Ni-63 Microirradiators

In this example, the recessed disk microirradiator probes of EXAMPLE 1 were implemented in radiobiological experiments.

The recessed disk microirradiator probes were used to induce DNA double strand breaks in live U2OS cells. Double strand breaks were visualized by attachment of a bright, photostable tag to a Tudor-domain containing fragment of the DSB-specific chromatin protein, 53BP1. The development of the photostable tag for 53BP1 was done as part of a National Institutes of Health Nanomedicine Center for the Development of Nucleoprotein Machines. Double strand breaks in live cells were seen as foci appearing inside the nucleus of the cell. These foci were counted to yield a quantitative value for damage within individual cells.

Specifically, labeled 53BP1 cells were exposed to a conventional $^{137}$Cs gamma source, known to cause double strand breaks, and the microirradiator probes of EXAMPLE 1. The collimated microirradiator probe was mounted inside the weather station of the Delta Vision RT deconvolution microscope (Applied Precision, Inc., Washington, USA) and positioned a distance about 5-10 mm directly above the target cell.

A stand had to be designed and installed inside the weather station cabinet of the Delta Vision Microscope to hold the microirradiator probe. A base stand was fabricated and secured to the table top. A small hole was drilled into the plexi-glass weather station cabinet which allowed for a main post to be inserted into the stand. A second metal bar was bent in a 90° degree angle and was secured to the main post. The bent post was where a commercially-available manual manipulator was attached and positioned to hold the microirradiator probes directly over the target cells. The development of the stand to hold the manipulator was novel to Delta Vision system. To the inventors' knowledge, this is the first time a manipulator has been used inside a Delta Vision weather station cabinet for any type of live cell imaging experiment.

Images were collected with a 60× Plan Achro oil objective and z-stack images were taken at 0.4 μm sections and deconvolved using SoftWoRx Software. Projection of 14-17 z-stack sections were fused into one layer.

Initial experiments showed that the number of foci observed following microirradiator exposure increased initially to a steady state value and have a half-life of approximately 10 minutes. Additional experiments that measure the repair kinetics of 53BP1 in live cells using both the microirradiator and the reference gamma radiation can also be performed.

The various embodiments of the present invention are not limited to the particular formulations, process steps, and materials disclosed herein as such formulations, process steps, and materials can vary somewhat. Moreover, the terminology employed herein is used for the purpose of describing exemplary embodiments only and the terminology is not intended to be limiting since the scope of the various embodiments of the present invention will be limited only by the appended claims and equivalents thereof. For example, temperature and time parameters can vary depending on the particular materials used.

Therefore, while embodiments of this disclosure have been described in detail with particular reference to exemplary embodiments, those skilled in the art will understand that variations and modifications can be effected within the scope of the disclosure as defined in the appended claims. Accordingly, the scope of the various embodiments of the present invention should not be limited to the above discussed embodiments, and should only be defined by the following claims and all equivalents.

What is claimed is:

1. A microirradiator, comprising:

a non-radioactive conducting electrode;

an insulating sheath disposed about at least a portion of the non-radioactive conducting electrode along a longitudinal axis of the non-radioactive conducting electrode; and a radioactive source in electrical communication with the non-radioactive conducting electrode, wherein the radioactive source is positioned at a terminus of a first longitudinal end of the non-radioactive conducting electrode via electroplating;

wherein the insulating sheath is disposed about at least a portion of the radioactive source along a longitudinal axis of the radioactive source.

2. The microirradiator of claim 1, wherein a terminus of the insulating sheath is level with a terminus of the radioactive source.

3. The microirradiator of claim 1, wherein a terminus of the insulating sheath extends beyond a terminus of the radioactive source to define a channel within the insulating sheath.

4. The microirradiator of claim 1, further comprising a contact electrode in electrical communication with the non-radioactive conducting electrode.

5. The microirradiator of claim 4, wherein the contact electrode is electrically coupled to the non-radioactive conducting electrode within the insulating sheath.

6. The microirradiator of claim 1, wherein the average thickness of the electroplated radioactive source along the longitudinal axis is less than or equal to about 50 micrometers.

7. The microirradiator of claim 1, wherein the microirradiator produces an absolute radiation of less than or equal to about 1000 Becquerels and a radiation flux density of greater than or equal to about $10^4$ Becquerels per square centimeter.

8. The microirradiator of claim 1, wherein the non-radioactive conducting electrode is an inert metal, the insulating sheath is a glass capillary tube, and the radioactive source is an elemental radioisotope.

9. The microirradiator of claim 1, wherein a target of radiation has an average longest cross-sectional dimension of less than or equal to about 30 micrometers.

10. A microirradiator, comprising:

a non-radioactive conducting electrode;

an insulating sheath disposed about at least a portion of the non-radioactive conducting electrode along a longitudinal axis of the non-radioactive conducting electrode, wherein a terminus of a first longitudinal end of the non-radioactive conducting electrode extends beyond the insulating sheath to define a probe; and a radioactive source in electrical communication with the non-radioactive conducting electrode, wherein the radioactive source is electroplated on the probe.

11. The microirradiator of claim 10, further comprising a contact electrode in electrical communication with the non-radioactive conducting electrode.

12. The microirradiator of claim 11, wherein the contact electrode is electrically coupled to the non-radioactive conducting electrode within the insulating sheath.

13. The microirradiator of claim 10, wherein the average thickness of the electroplated radioactive source on the probe is less than or equal to about 50 micrometers.

14. The microirradiator of claim 10, wherein the microirradiator produces an absolute radiation of less than or equal to about 1000 Becquerels and a radiation flux density of greater than or equal to about $10^4$ Becquerels per square centimeter.

15. The microirradiator of claim 10, wherein the non-radioactive conducting electrode is an inert metal, the insulating sheath is a glass capillary tube, and the radioactive source is an elemental radioisotope.

16. The microirradiator of claim 10, wherein the microirradiator is configured to be inserted into a target of radiation.

17. The microirradiator of claim 16, wherein the target of radiation has an average longest cross-sectional dimension of less than or equal to about 30 micrometers.

18. A method for making a microirradiator, the method comprising:

disposing an insulating sheath about at least a portion of a non-radioactive conducting electrode; and electroplating a radioactive source at or about a terminus of a first longitudinal end of the non-radioactive conducting electrode.

19. The method for making a microirradiator of claim 18, wherein the disposing comprises inserting the non-radioactive conducting electrode into the insulating sheath.

20. The method for making a microirradiator of claim 18, further comprising electrically coupling a contact electrode to the non-radioactive conducting electrode.

* * * * *